US010793230B2

(12) United States Patent
Lisland

(10) Patent No.: US 10,793,230 B2
(45) Date of Patent: Oct. 6, 2020

(54) METHOD AND AN ARRANGEMENT FOR REMOVING STRETCH IN POLYESTER MOORING LINES WITH AN INLINE TENSIONER

(71) Applicant: SCANA OFFSHORE AS, Vestby (NO)

(72) Inventor: Torkjell Lisland, Drøbak (NO)

(73) Assignee: SEASYSTEMS AS, Vestby (NO)

( * ) Notice: Subject to any disclaimer, the term of this patent is extended or adjusted under 35 U.S.C. 154(b) by 0 days.

(21) Appl. No.: 16/497,193

(22) PCT Filed: Mar. 26, 2018

(86) PCT No.: PCT/EP2018/057624
§ 371 (c)(1),
(2) Date: Sep. 24, 2019

(87) PCT Pub. No.: WO2018/178002
PCT Pub. Date: Oct. 4, 2018

(65) Prior Publication Data

US 2020/0094922 A1 Mar. 26, 2020

(30) Foreign Application Priority Data

Mar. 27, 2017 (NO) ..... 20170500

(51) Int. Cl.
*B63B 21/50* (2006.01)

(52) U.S. Cl.
CPC ..... *B63B 21/50* (2013.01); *B63B 2021/505* (2013.01)

(58) Field of Classification Search
CPC combination set(s) only.
See application file for complete search history.

(56) References Cited

U.S. PATENT DOCUMENTS 5,390,618 A 2/1995 Wolff et al.
2014/0026796 A1* 1/2014 Leverette ..... B63B 21/50 114/230.24

(Continued)

FOREIGN PATENT DOCUMENTS

NO 335406 B1 12/2014
NO 20160964 A1 12/2017

(Continued)

OTHER PUBLICATIONS

Gardel, Antony; International Search Report for PCT/EP2018/057624; dated Jun. 7, 2018; 4 pages.

*Primary Examiner* — Kyle Armstrong
(74) *Attorney, Agent, or Firm* — Shackelford, Bowen, McKinley & Norton, LLP

(57) ABSTRACT

The invention relates to a mooring tensioning arrangement for a floating structure or a vessel (11), comprising -a mooring line (3, 5, 7) having a first mooring part (3) and a second mooring part (5, 7), divided by a midwater coupling (4, 40, 400, 111), said at least a portion of the mooring line (3, 5, 7) is made of synthetic material, -said mooring line (3, 5, 7) is extending between an anchor (2) arranged on the seabed and a pulling unit (9, 10, 42) arranged separate from the floating structure or vessel (11), said mooring line (3, 5, 7) is extending at least via a fairlead pulley or a chain wheel (8, 80) arranged on the floating structure (11) between the anchor and the pulling unit (9, 10, 42) when the mooring line (3, 5, 7) being pre-tensioned, -a chain stopper (6, 60) being arranged in connection with the mooring line (3, 5, 7) between the anchor (2) and the floating vessel or structure (11) for tensioning the part of the mooring line (3, 5, 7) situated between the floating structure (11) and the anchor (2) at a pretension level. The mooring tensioning arrangement further comprising a second tensioning line (100) configured to be attached in one end to the midwater (Continued)

coupling (4, 40, 400) and in the other end coupled to the pulling unit (9,10, 42) when said mooring line (3, 5, 7) being re-tensioned, said midwater coupling (4, 40, 400) and the pulling unit (9, 10, 42) being arranged relative each other such that the tensioning line (100) is configured to impose a lateral force on the part of the mooring line (3, 5, 7) arranged between the anchor (2) and the floating structure (11) for removing stretch in the mooring line (3, 5, 7). The invention also relates to a method tor tensioning the mooring tensioning arrangement.

20 Claims, 12 Drawing Sheets

(56) References Cited

U.S. PATENT DOCUMENTS

| | | | | |
|---|---|---|---|---|
| 2014/0216323 | A1 | 8/2014 | Macrae | |
| 2016/0176480 | A1* | 6/2016 | Hovde | B63B 21/20<br>114/230.22 |
| 2017/0349243 | A1 | 12/2017 | Lisland | |
| 2020/0055569 | A1* | 2/2020 | Atallah | B63B 21/56 |

FOREIGN PATENT DOCUMENTS

| | | | | |
|---|---|---|---|---|
| WO | WO-2013004749 | A1 | 1/2013 | |
| WO | WO-2014083056 | A1 | 6/2014 | |
| WO | WO-2018197883 | A1 * | 11/2018 | B63B 21/08 |

* cited by examiner

METHOD AND AN ARRANGEMENT FOR REMOVING STRETCH IN POLYESTER MOORING LINES WITH AN INLINE TENSIONER

TECHNICAL FIELD

The present invention relates to mooring and tensioning of mooring lines for floating structures or vessels, such as Floating Production, Storage and Offloading vessels (FPSO's), semi-submersible platforms, turret moored vessels, floating drilling rigs, drilling ships and other floating structures which are moored to the seabed.

The invention is more specifically directed to a method and an arrangement for removing stretch in polyester lines together with the mooring tensioning arrangement.

BACKGROUND ART

Structures and vessels that are supposed to stay moored at the same location for a long time, such as months or years, have to be moored with a prescribed tension. The traditional method is to use chain tensioning equipment on deck for pull-in and tensioning. Normally this equipment is used during the installation period and left on the vessel for a number of years without being used or maintained. When the mooring lines slacken sufficiently over time, due to wear of chains, shifting of anchors, creep in fiber mooring lines etc, the mooring lines have to be re-tensioned, repositioned (typically move the chain one or two chain links in order to engage the chain stopper on a new chain link) or replaced. In this period between installation and next operation, the equipment has normally seized or corroded and requires refurbishment.

The mooring line that is used in the mooring of a floating structure or vessel usually comprising one or more segments of rope containing e.g polyester.

When a new polyester mooring line is tensioned, it tends to elongate over time due to visco-elastic stretch and permanent unrecoverable stretch. In a permanent mooring system on a floating unit with a riser system and/or drill string, this may be a problem if the elongation of the polyester causes the vessel to move outside the acceptable excursion circle. There are in principle two ways to ensure that this does not happen.

1. Pre-stretch the mooring lines and take out the elongation during the installation phase.

2. After the installation is finished, perform re-tensioning with the onboard mooring winches when the pre-tension level (as a function of the elongation) has fallen below the calculated pretension level or excessive vessel excursion is reached.

Usually a combination of 1 and 2 is performed. Pre-stretch as much as possible during installation and re-tension when required. During the pre-stretching, the tension level should be minimum 40% of the minimum brake load (MBL) of the mooring line. MBL levels are typically in the region of 1000-3000 tons.

The FIG. 1 illustrates this principle.

The permanent pre-tension level is approximately 11% of MBL. During the installation, the black curve, the mooring winches tensions the mooring line up to 25% of MBL and keeps this tension for one hour. In this period the polyester elongates up to about 6.5%. When unloaded down to the 11% pre-tension level some of the elongation is relieved. However, the permanent elongation is increased from 2.5% to 5%. The red and blue curves illustrate the result if a higher pretension level had been used.

In a traditional mooring system with mooring winches on deck, performing re-tension is a normal operation as the equipment is available.

With an inline tensioner system where there is no tensioning equipment installed on the vessel it will require a support vessel to perform the task. This may be a challenge if there are no suitable support vessels available at the location. Due to this, it is beneficial to remove as much as possible of the stretch during the installation phase.

This patent application describes a method and an arrangement where it is possible to remove a large portion of the stretch in combination with an inline tensioner system.

The principle can be seen in FIG. 2 where the installation is used to tension by pulling close to 90 degrees (perpendicular) on the mooring line.

The FIG. 2 shows that by pulling in this direction, a very high pretension load can be reached.

By combining the inline tensioner for reaching the required permanent pre-tension level with this tensioning perpendicular to the mooring line, a costly re-tensioning operations are greatly reduced.

The aim of this patent application is also to provide a method and arrangement where there is little or no requirement for equipment on the deck of the vessel and still be able to perform the installation, tensioning, re-tensioning, re-positioning, replacement operations and together with these operation also remove as much as possible of the stretch in the polyester rope that is used in the mooring of the floating structure. This will reduce the need for costly re-tensioning of the mooring arrangement that is required on prior mooring arrangements.

US 2014/0216323 A1 describes a mooring arrangement and a method of installing the mooring arrangement. A chain is attached to the seabed by an anchor. A submerged chain tensioner is attached to an upper end of the chain. A pull chain or installation chain extends from the structure to be anchored through the chain tensioner. The lower end of the installation chain is pulled upwards by the use of a winch on the support vessel until the installation chain passes through the chain stopper, a prescribed tension is achieved and the chain stopper engages on the permanent part of the mooring line, here described as the work chain. The publication discloses that the polyester rope arranged between the anchor and the chain tensioner will creep over time, but the publication do not have any suggestion to solve this problem other than re-tensioning over time by pulling in a new installation chain part.

None of the invention mentioned above discloses a method and an apparatus that remove this creeping of the polyester rope in the first installation process and reduce the need for re-tensioning of the mooring arrangement after a while.

Object of the Present Invention

It is expensive to use an installation of support vessel every time a re-tensioning of the mooring is required. It is therefore an object of the invention to remove creep in a polyester line that is used in the mooring arrangement at the same time as the mooring is performed in order to reduce the need of re-tensioning again after the installation process.

It is also an object of the invention to provide an arrangement and method for installation, tensioning and replacement of mooring lines where there is no requirement for chain handling on the deck of the floating structure.

Tensioning can be performed from an installation vessel and in particular smaller vessels due to multiplication of the tensioning force from the pulley arrangement. The multiplication factor could be up to 3 depending on the arrangement of the mooring line and also of the actual angle and friction.

The removal of strength in the polyester line is also possible to perform with a smaller vessel since the latitudinal force results in a greater resultant tensioning force in the mooring line than if the force is in the longitudinal direction.

The invention also has an objective to avoid additional weight midwater on the mooring line from the chain stopper structure and the excess mooring chain. A wire sheave or only a coupling positioned mid-water has considerable less weight than a chain stopper pulley and excess mooring chain.

It is also an objective to avoid the problem of having to account for a certain amount of overtightening when installing a mooring or re-tensioning the mooring of the floating structure.

SUMMARY OF THE INVENTION

The invention relates to a method for tensioning a mooring arrangement for a floating structure or a vessel, said mooring tensioning arrangement comprising a mooring line having a first mooring part and a second mooring part, divided by a midwater coupling, said at least a portion of the mooring line is made of synthetic material, said mooring line is extending between an anchor arranged on the seabed and a pulling unit arranged separate from or attached to the floating structure or vessel, said mooring line is extending at least via a fairlead pulley or chain wheel arranged on the floating structure between the anchor and the pulling unit wherein the method comprising the following steps:

a) imposing a pre-tensioning force on said mooring line by tightening the mooring line by the pulling unit, said force being directed towards said floating structure or vessel, until a pretension level in the mooring line is reached, b) maintaining the pretension level in the part of the mooring line extending between the anchor and the floating structure c) arranging a second tensioning line between said midwater coupling and the pulling unit, d) imposing a substantially transverse force on the part of the mooring line extending between the anchor and the floating structure in order to remove stretch in the mooring line.

e) retightening of the mooring line.

When the first mooring part is made of the synthetic material, the stretch is removed in this part.

The invention also relates to a mooring tensioning arrangement for a floating structure or a vessel, comprising a mooring line having a first mooring part and a second mooring part, divided by a midwater coupling, said at least a portion of the mooring line is made of synthetic material, said mooring line is extending between an anchor arranged on the seabed and a pulling unit arranged separate from the floating structure or vessel, said mooring line is extending at least via a fairlead pulley or a chain wheel arranged on the floating structure between the anchor and the pulling unit when the mooring line being pre-tensioned, a chain stopper being arranged in connection with the mooring line between the anchor and the floating vessel or structure for tensioning the part of the mooring line situated between the floating structure and the anchor at a pretension level. The mooring tensioning arrangement further comprising a second tensioning line configured to be attached in one end to the midwater coupling and in the other end coupled to the pulling unit when said mooring line being re-tensioned, said midwater coupling and the pulling unit being arranged relative each other so that the tensioning line is configured to impose a lateral force on the part of the mooring line arranged between the anchor and the floating structure for removing stretch in the mooring line.

The method and arrangement according to the invention provides an easy, effective and cost reducing method and arrangement for mooring a floating structure or a vessel.

Preferable method and mooring tensioning arrangements are set out in the dependent claims, to which reference are made.

The method for tensioning a mooring arrangement for a floating structure or a vessel comprising at least a mooring tensioning arrangement with a mooring line having a first mooring part and a second mooring part, divided by a midwater coupling, said at least a portion of the mooring line is made of synthetic material, said mooring line is extending at least between an anchor arranged on the seabed and a fairlead arrangement attached to the floating structure. The method comprising the following step:

Imposing and maintaining a pretension force on said mooring line;

arranging a second tensioning line between said midwater coupling and a pulling unit;

imposing a substantially transverse force on the part of the mooring line extending between the anchor and the floating structure in order to remove stretch in the mooring line.

In one embodiment, the said chain stopper being connected to the fairlead arrangement.

In another embodiment, the chain stopper being connected to the midwater coupling.

In yet another embodiment, said chain stopper being arranged between the midwater coupling and the floating structure.

DETAILED DESCRIPTION OF THE INVENTION

The foregoing features of the invention will be more readily understood by reference to the following detailed description taken with reference to the accompanying drawings.

The definitions in the application shall be interpreted broadly throughout the application.

The attached figures describes three different embodiments of a combined pre-tensioning arrangement and polyester stretch removal arrangement according to the invention. The pre-tensioning arrangement of the mooring line is also called inline tensioner.

The inline tensioners can reach a pre-tension level of 1×, 2× and 3× the bollard pull of the installation vessel. Friction, actual angels etc will reduce these figures.

Features that are equal in the different embodiments of the invention have the same reference sign throughout the whole description and claims.

Figure 1:
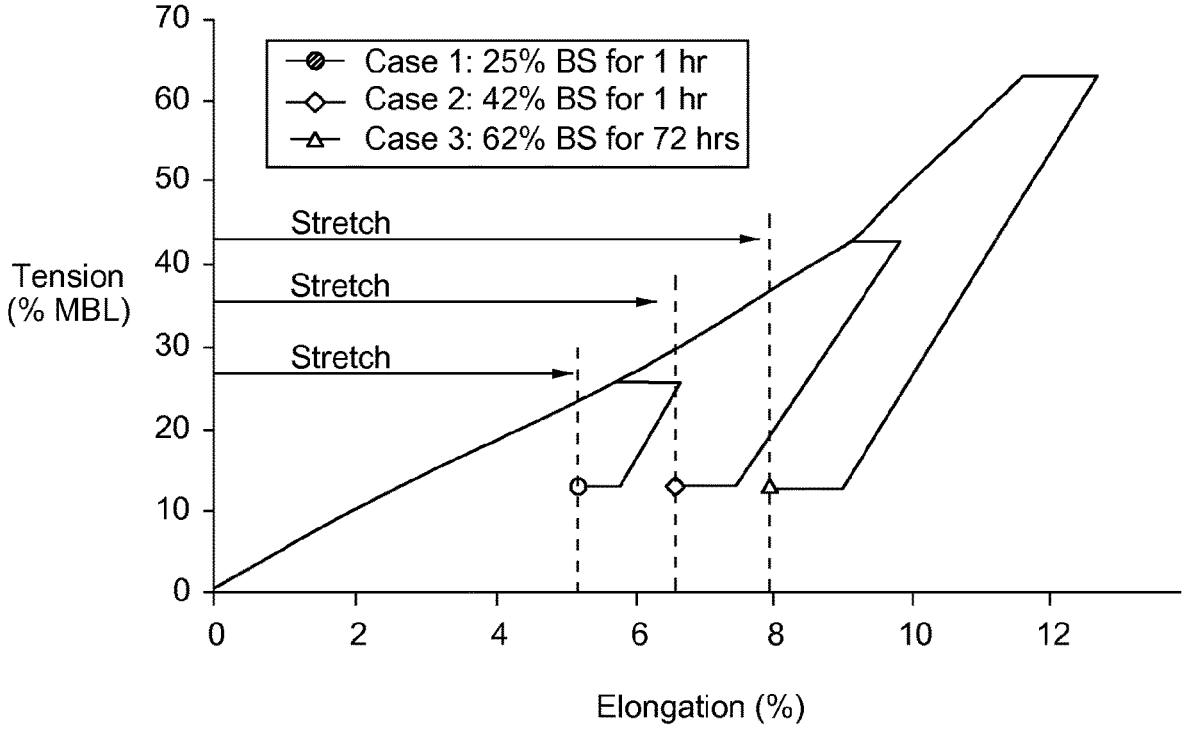
FIG. 1 (Prior Art)
FIG. 1 shows a principle sketch of the ratio between the tension and the elongation of a polyester rope.
Figure 2:
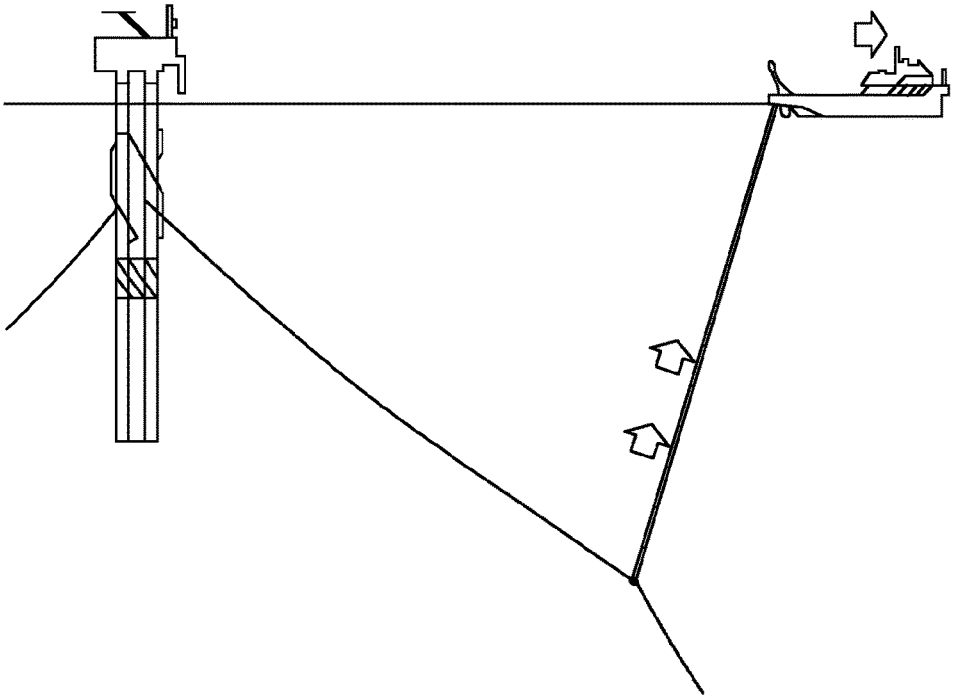
FIG. 2 (Prior Art)
FIG. 2 shows a principle sketch of a pulling action to remove stretch in an easy manner in spar buoy that is moored to the seabed by conventional methods.
Figure 3:
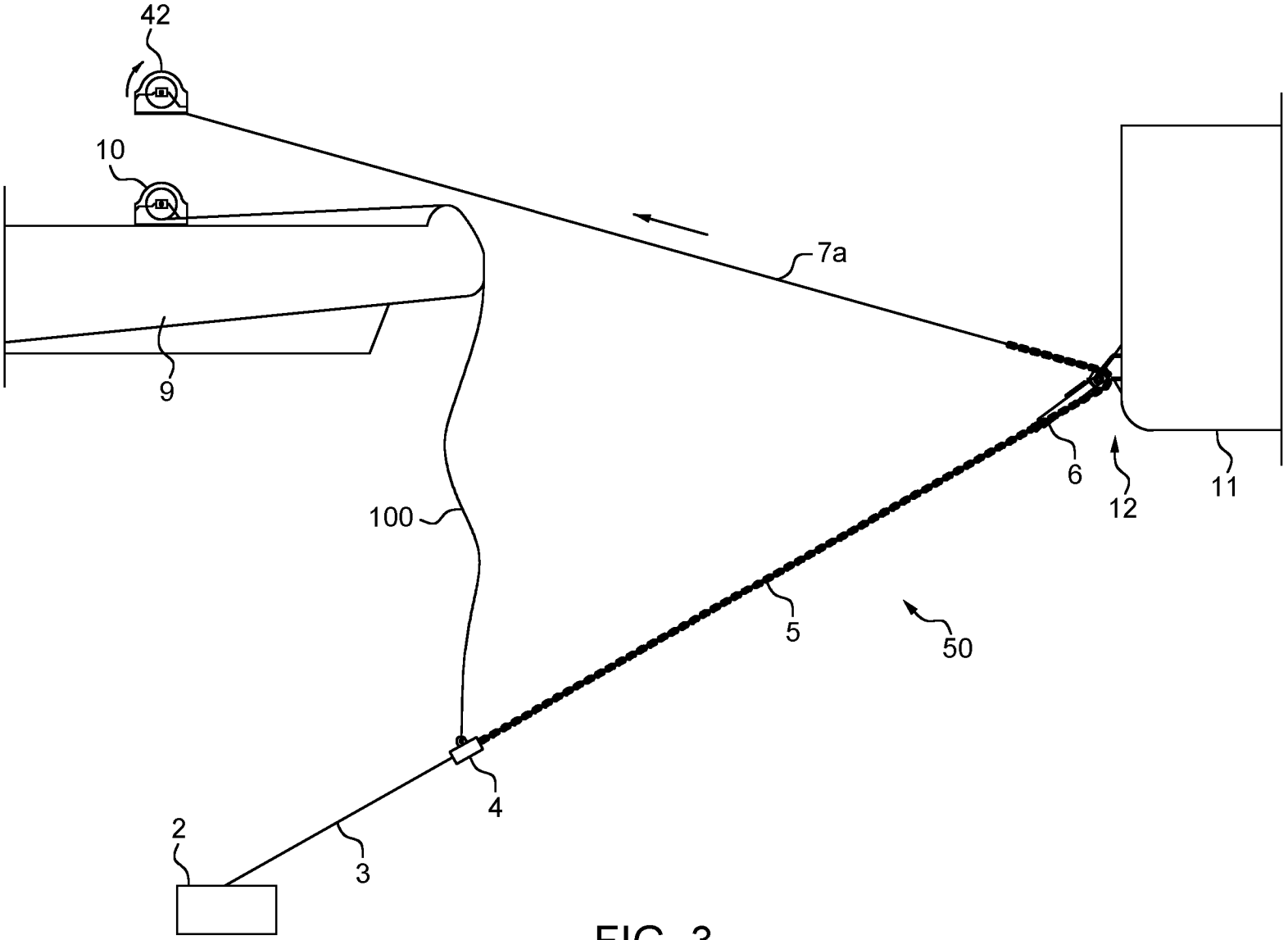
FIG. 3 shows the tensioning of the mooring line up to a pretension level with a mooring line arrangement according to a first embodiment of the invention.
Figure 4:
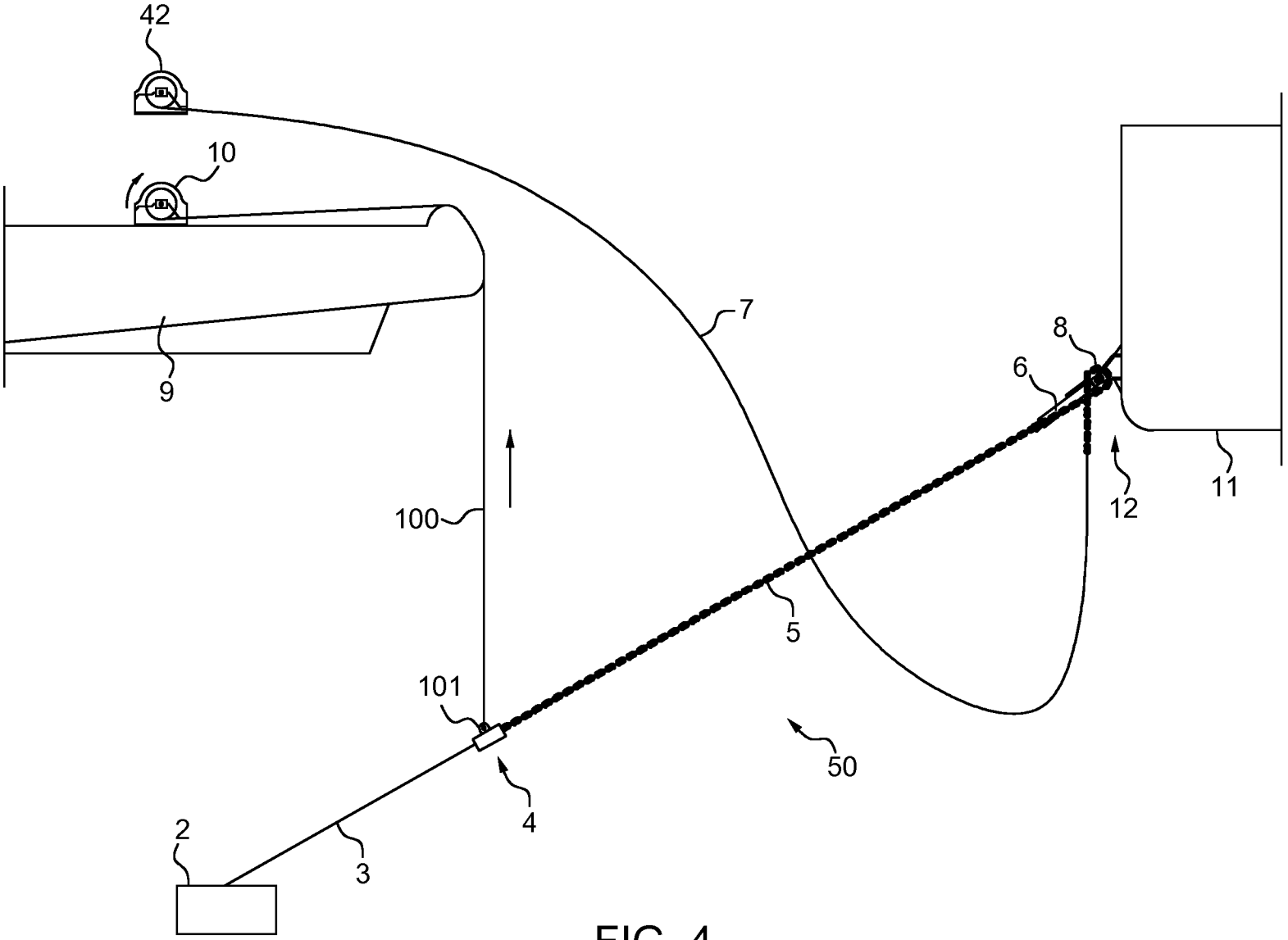
FIG. 4 shows the tensioning of the polyester line to remove creep in the line of the first embodiment of the invention as shown in FIG. 3.

FIGS. 3 and 4 shows a first embodiment of the inline tensioner according to the invention. In this embodiment, the pretension can reach a pretension level of 1× bollard pull of an installation vessel 9 as will be further described.

FIG. 3 shows the arrangement for pre-tensioning a mooring line up to a pretension level.

A tensioning mooring arrangement 50 is installed between an anchor 2 that has been attached to the seabed 1 and a floating structure 11, such as an FPSO. This installation is further performed by help of an installation vessel or a pulling unit 9.

The anchor 2 is conveniently a suction anchor, but it may alternatively be any type of anchor known in the field.

The pre-tensioning mooring arrangement 50 further comprises a mooring line 3, a midwater coupling 4 and a chain stopper arrangement 12.

The term midwater coupling 4 is to be interpreted broadly and not as an indication that the midwater coupling 4 has to be positioned midwater. The term indicates that the coupling installed anywhere on the mooring line 3, 5 between the anchor 2 and the fairlead chain stopper arrangement 12 in a distance from the anchor 2 and the fairlead chain stopper arrangement 12 or the fair lead pulley arrangement 120. The term midwater coupling is to be interpreted as any coupling adapted to connect with a tensioner line 100 as will we described further below, also a coupling integrated in the mooring line parts 3 and 5.

A fairlead chain wheel 8 and a chain stopper 6 are in this embodiment arranged together in the chain stopper arrangement 12, which is capable of retaining the part of the mooring line 3, 5, 7 that is situated between the anchor 2 and the floating structure 11 in a pre-tension position. The chain stopper arrangement 12 is preferably attached to the lower portion of the floating structure 11. Any position on the hull of the floating structure 11 is however possible.

The mooring line 3, 5, 7 is defined as the different parts of ropes, chains or wires etc that is creating a linear connection between the anchor 2 at the seabed, the floating structure 11 and the installation vessel 9. The mooring line 3, 5, 7 comprises individual parts as a mooring rope 3, a mooring chain 5 and an installation wire 7. It is to be noted that the term rope, chain and wire are used to distinguish the parts from each other and are to be construed broadly. The mooring rope, mooring chain and installation wire could all comprise parts of wire, chain or polyester ropes.

A typical mooring line 3, 5, 7 comprises for instance an anchor 2, a bottom chain 3, a polyester rope 3, top chain 5 and a fastening point to the offshore structure 11.

The different parts may be connected together or coupled together via a common coupling as will be described in further detail. There could for instance be polyester rope segments connected directly to both sides of the common coupling.

In the embodiments shown in the figures, the mooring rope 3 is a separate part which extends between the anchor 2 arranged at the seabed and a midwater coupling 4. A possible embodiment of the invention is that the mooring rope 3 and the mooring chain 5 is attached directly to each other. The midwater coupling 4, 40, 400 is then attached to the mooring line 3, 5 at a suitable position.

At least a part of the mooring rope 3 is made of a synthetic material. The most preferable synthetic material for the mooring rope 3 is polyester. The whole mooring rope 3 could be made of the synthetic material or the mooring rope 3 could be a combination of an anchor chain, a steel wire and the synthetic material. A mooring rope 3 comprising an anchor chain connected to the anchor and a polyester rope further connected to the anchor chain is most common construction of the mooring rope 3. The polyester rope is further connected to the midwater coupling 4.

The mooring chain 5 is in the opposite end of the midwater coupling 4 connected to the midwater coupling 4 and extends towards the floating structure 11, through the chain stopper 6 and around the fairlead chain wheel 8 as shown in the FIG. 3.

At a distance from the fairlead chain wheel 8, the end of the mooring chain 5 is connected to the installation wire 7. The installation wire 7 extends further towards the installation vessel 9. The installation wire could also as an embodiment extend towards a pulling unit (not shown) arranged on the floating structure 11

As an embodiment, the mooring chain 5 could also extend all the way to the installation vessel or pulling unit 9, or a short piece of installation chain (not shown) may be used between the mooring chain 5 and the installation wire 7.

The mooring chain 5 could also comprise polyester rope or a rope made of a synthetic material similar as in the mooring rope part 3. This is not shown, but it is an embodiment of the invention in all of the mooring arrangements according to the invention.

The installation wire 7 is connected to a first winch 42 arranged on the installation vessel or pulling unit 9 or a winch (not shown) on the floating structure 11.

This first winch 42 is adapted to pull-in the mooring line 3, 5, 7 to create a tensioning of the mooring line 3, 5, 7. When the pre tensioned level are reached, the first winch 42 pays out and activates the chain stopper 6 to maintain the pretension of the part of the mooring line 3, 5 that is arranged between the anchor 2 and the floating structure 11.

The chain stopper arrangement 12 and the attachment to the floating vessel 11 are not shown in any further detail. Possible attachment to the hull of the floating structure 11 are disclosed in the Norwegian application NO20160964 which are incorporated herein by reference. The chain stopper 6 comprising a channel through which the mooring chain 5 can pass. The chain stopper 6 may have a single latch or consist of two latches, both are known per se. The latch or latches may be operated by a spring which closes the latch or latches towards a closed position to ensure safe closing of the latch or latches. The activation of the chain stopper 6 result in that the mooring chain 5 is locked in this position and may not move in the longitudinal direction of the chain stopper 6.

The deactivation or opening of the chain stopper 6 may be performed by a permanent hydraulic cylinder, mechanically with lever arm, links and/or wires or as another option with a temporary mechanical or hydraulic tool operated from the FPSO or the vessel 11 performing the chain operation.

In addition to the pretension arrangement, the mooring arrangement further comprises a stretch removal arrangement also called re-tensioning arrangement which is adapted to further stretch the mooring line 3, 5 to remove the creep in mooring rope 3 and or the mooring part 5 over time in an easy way at the same time as the pre-tensioning process. As mentioned above the rope 3 made of polyester tend to creep over time due to tension forces acting on the mooring rope 3. The tensioning forces created by the installation vessel 9 in the pre-tensioning of the mooring line 3, 5, 7 is however not large enough to remove the stretch in the polyester.

The stretch removal arrangement or re-tensioning arrangement comprises a second tensioner line 100 and a second winch 10 arranged on the installation vessel 9. This line 100 is extending between the midwater coupling 4 and the support vessel 9. The second line 100 is arranged in connection with the second winch 10 on the support vessel 9. The second winch 10 is configured to pull-in the second tensioner line 100.

The tensioning of the tensioner line 100 is shown in FIG. 4.

The midwater coupling 4 and the installation vessel 9 are arranged in relation to each other so that the tensioner line 100 is arranged in a substantially perpendicular line from the part of the mooring line between the installation vessel 9 and the anchor 2.

The angle between the tensioning line 100 and the mooring part 5 could also be less than 90°.

The tensioner line 100 is extending from the midwater coupling 4. This arrangement results in that the stretch removal arrangement imposes a lateral force on the part of the mooring line 3, 5 situated between the anchor 2 and the offshore structure 11.

This way of arranging the stretch removal arrangement 10, 100 results in a geometric amplification of the pull in by the winch 10 thus enabling application of higher loads on the mooring line 3, 5 than are achievable by direct bollard pull to tension the mooring line 3, 5 in the longitudinal direction of the mooring line 3, 5.

The stretch removal arrangement results in a stretch of the mooring line 3, 5 between the anchor 2 and the floating arrangement 11 which is visible as a slackened mooring line 3, 5 between the anchor 2 and floating structure 11

The mooring line 3, 5, 7 is then tighten to a new pre-tensioned level. This is performed in a same way as described above for the pretension related to FIG. 3.

The installation wire 7 may however be disconnected from the mooring chain 5 when the re-tensioning process is performed. This is not shown in the FIG. 4 but is a possible embodiment of the invention. A retightening process or a further re-tensioning process could then be repeated later.

In this case the same winch may be used in both the pre-tensioning process and in the re-tensioning process. It is not necessary with both the winches 10, 42.

The steps can be repeated until a level of stretch removal of the mooring rope 3 is obtained.

The method steps for of pretension and removal of creep is the same in the two other embodiments that is disclosed in FIG. 5-12. The difference in the other embodiments in FIG. 5-12 are that the mooring line 3, 5, 7 have a different arranging of the mooring line.

Figure 5:
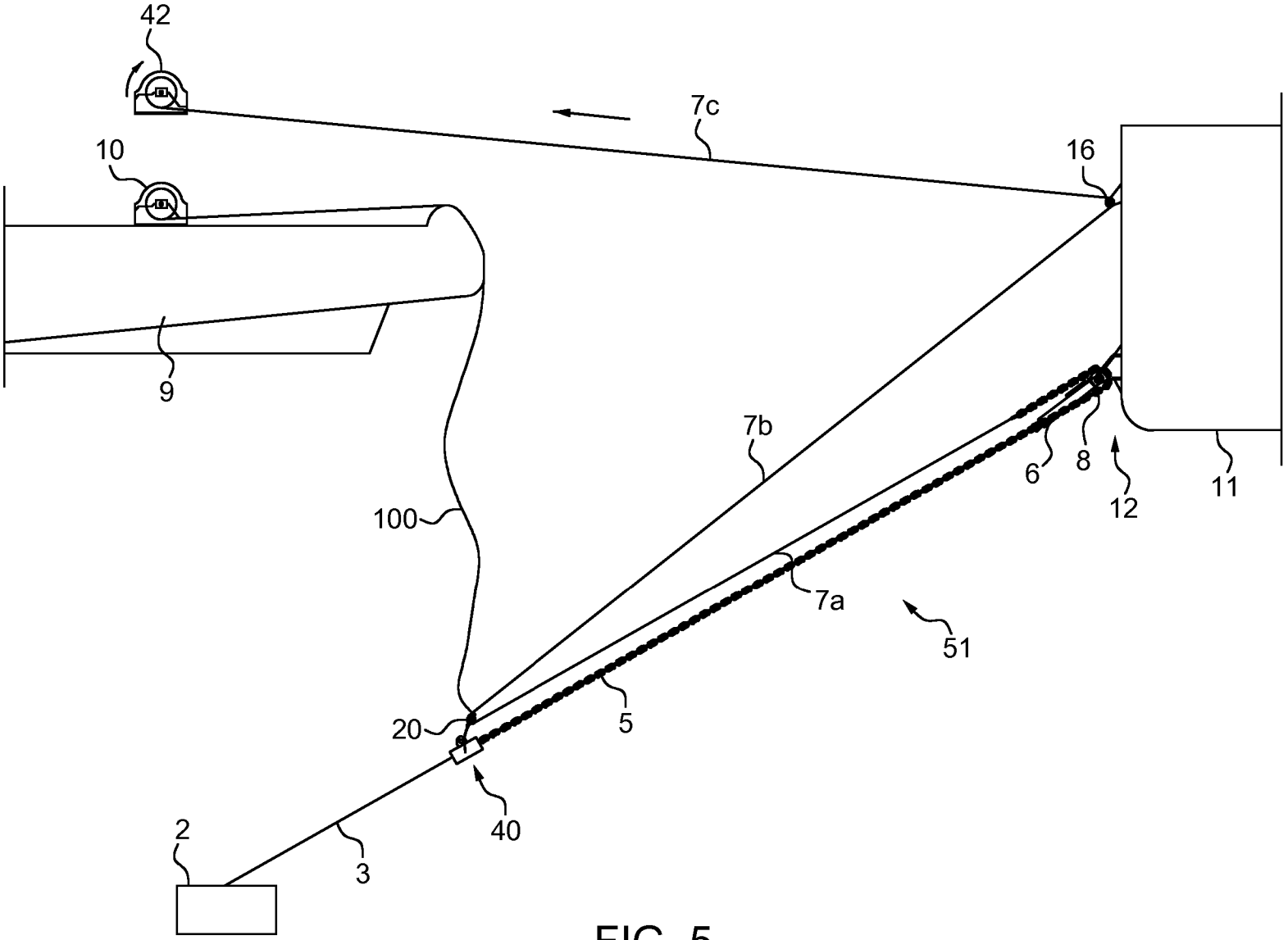
FIG. 5 shows the tensioning of the mooring line up to a pretension level with an arrangement according to a second embodiment of the invention.

FIGS. 5 and 6 discloses a second embodiment of the inline tensioner according to the invention. In this embodiment, the pretension can reach a pretension level of 3× bollard pull of the installation vessel 9 as will be further described below. This means that the arrangement of the pretension arrangement results in a tensioning force from the installation vessel up to three times higher than the arrangement shown in FIG. 3-4.

FIG. 5 shows the arrangement for the pre-tensioning the mooring line 3 up to the pre-tension level obtained by the installation vessel 9.

In addition to the pretension arrangement 50 as disclosed in the first embodiment in FIGS. 3 and 4, the pretension mooring arrangement 51 in this embodiment further comprises a midwater coupling 40 having a midwater pulley 20. There is also arranged a wire pulley 16 on the floating structure 11. The wire pulley 16 is preferably arranged on the hull of the floating structure 11 above the chain stopper arrangement 12.

The mooring line 3, 5, 7 comprise three parts as disclosed in the first embodiment but as for the first embodiment, the part may also have segments with polyester ropes in some or all of the parts of the mooring line 3, 5, 7.

The installation wire 7 is in this embodiment extending via the midwater pulley 20 and the wire pulley 16 towards the installation vessel 9. The installation wire 7 is divided in a first flight 7*a* connected to the mooring chain 5 in one end and extending towards the midwater pulley 20. A second flight 7*b* extending from the midwater pulley 20 towards the wire pulley 16. A third flight 7*c* is extending from the wire pulley 16 towards the installation vessel 9. The flights 7*a*, 7*b* and 7*c* constitute a continuous wire or line 7. The installation wire 7 may also comprise a portion of polyester rope, other ropes or a chain.

The first flight 7*a* of the installation wire 7 is substantially parallel to the mooring chain 5. More general, the part of the mooring line 3, 5, 7 extending between the midwater coupling 40 and the chain stopper arrangement 12 is substantially parallel with a further part of the mooring line 3, 5, 7 extending back from the chain stopper arrangement 12 towards the midwater coupling 40.

Figure 6A:
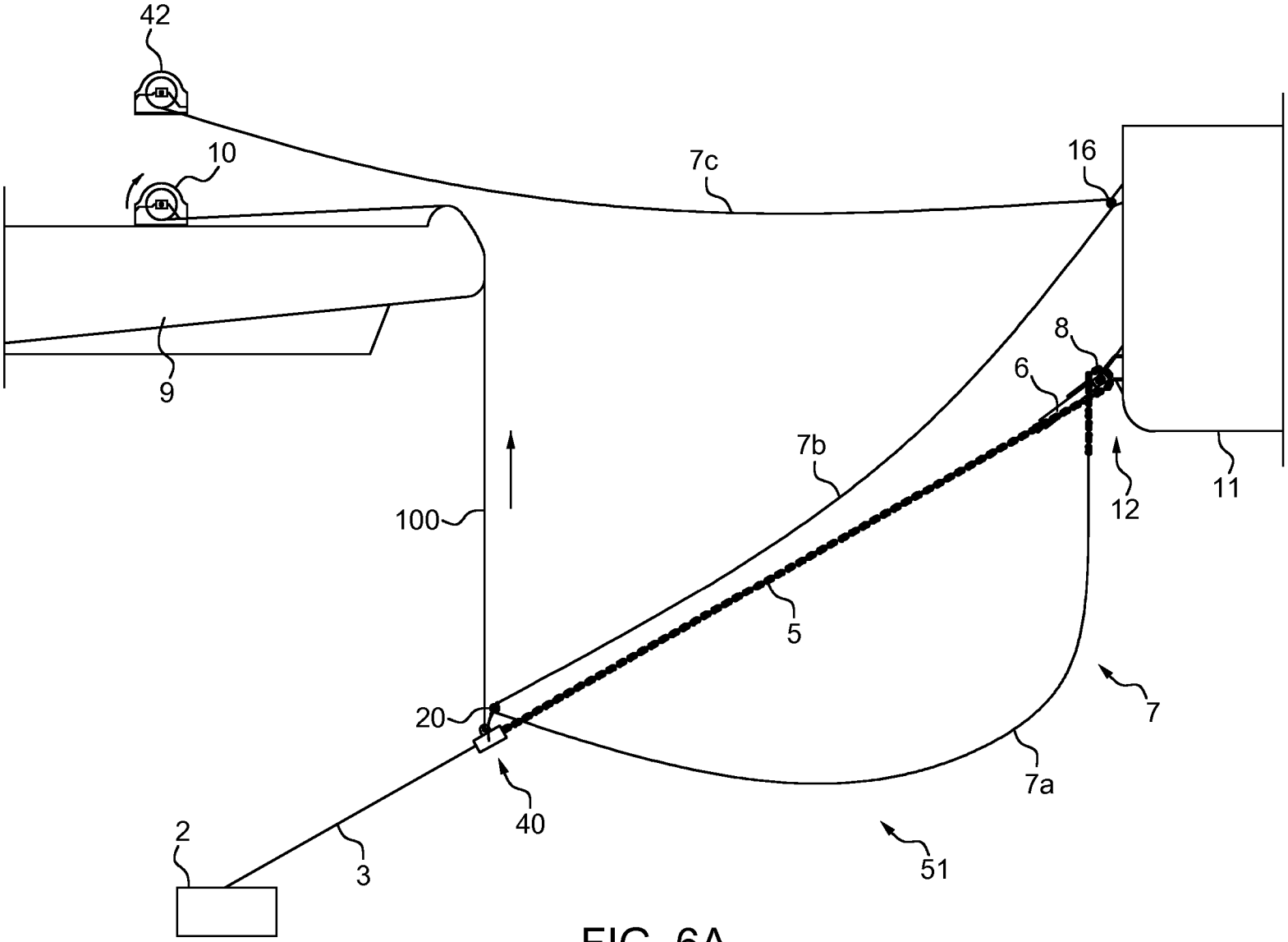
FIG. 6*a* shows the tensioning of the polyester line to remove creep in the line of the second embodiment of the invention as shown in FIG. 5.

The FIG. 6*a* shows the stretch removal arrangement 10, 100 with the second tensioning line 100 arranged between the midwater coupling 40 and the installation vessel 9. The second winch 10 is configured to pull in the second tensioning line 100 to impose the latitudinal force on the part of the mooring line 3, 5 situated between the anchor 2 and the floating structure 11 as described in FIG. 3.

The midwater coupling 40 in this embodiment could also be a midwater pulley device 41 which is also described in the corresponding US application U.S. Ser. No. 15/335191 from the same applicant. The application discloses bot temporary and permanently arranged midwater pulley devices. A temporary midwater coupling 41 is disclosed in FIG. 6*b* where the pulley 41 is releasable connected to the mooring line 5 through a hook 42.

The midwater pulley device could be also permanently arranged on the mooring line 3, 5, 7. The permanently arranged midwater arrangement may be attached to a continuous mooring line 3, 5, 7 or the midwater pulley device 41 could be an integrated part of the mooring line 3, 5, 7. In all the embodiments of the midwater pulley device 41, the midwater coupling 4, 40, 400, 111 could be an integrated part of the midwater pulley device 41 or a separate arrangement.

Figure 6B:
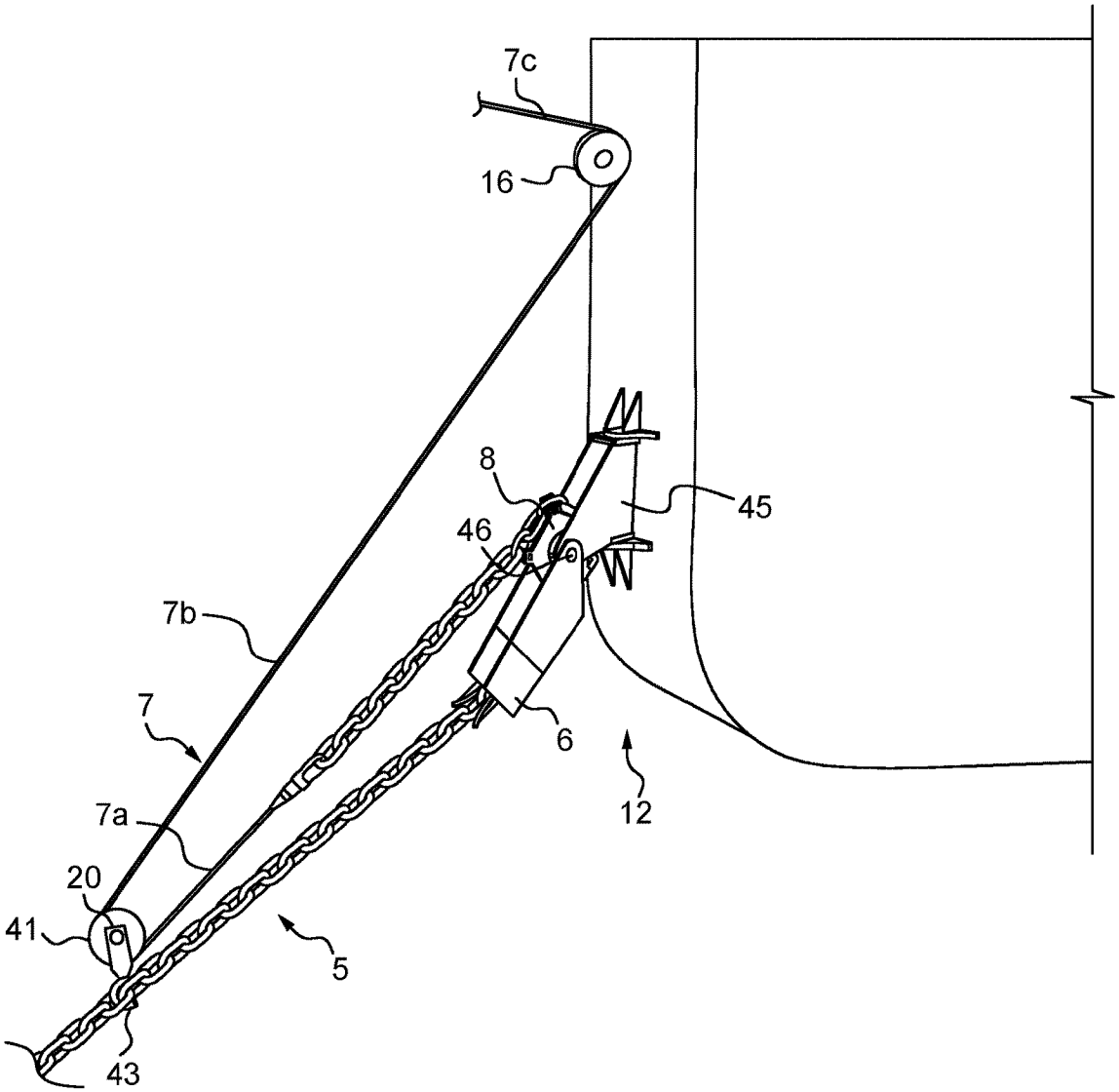
FIG. 6*b* shows a similar arrangement of the mooring line as in FIG. 5 with a temporary connectable midwater pulley arrangement.

The FIG. 6*b* further discloses a bracket 45 attached to the floating structure 11. The chain stopper arrangement 12 is in this embodiment is pivotably attached to the bracket 110 through a connection 46. The chain stopper arrangement 12 further comprising a chain stopper 6 and a fairlead chain wheel 8 as shown in the FIG. 6*b*.

Figure 7:
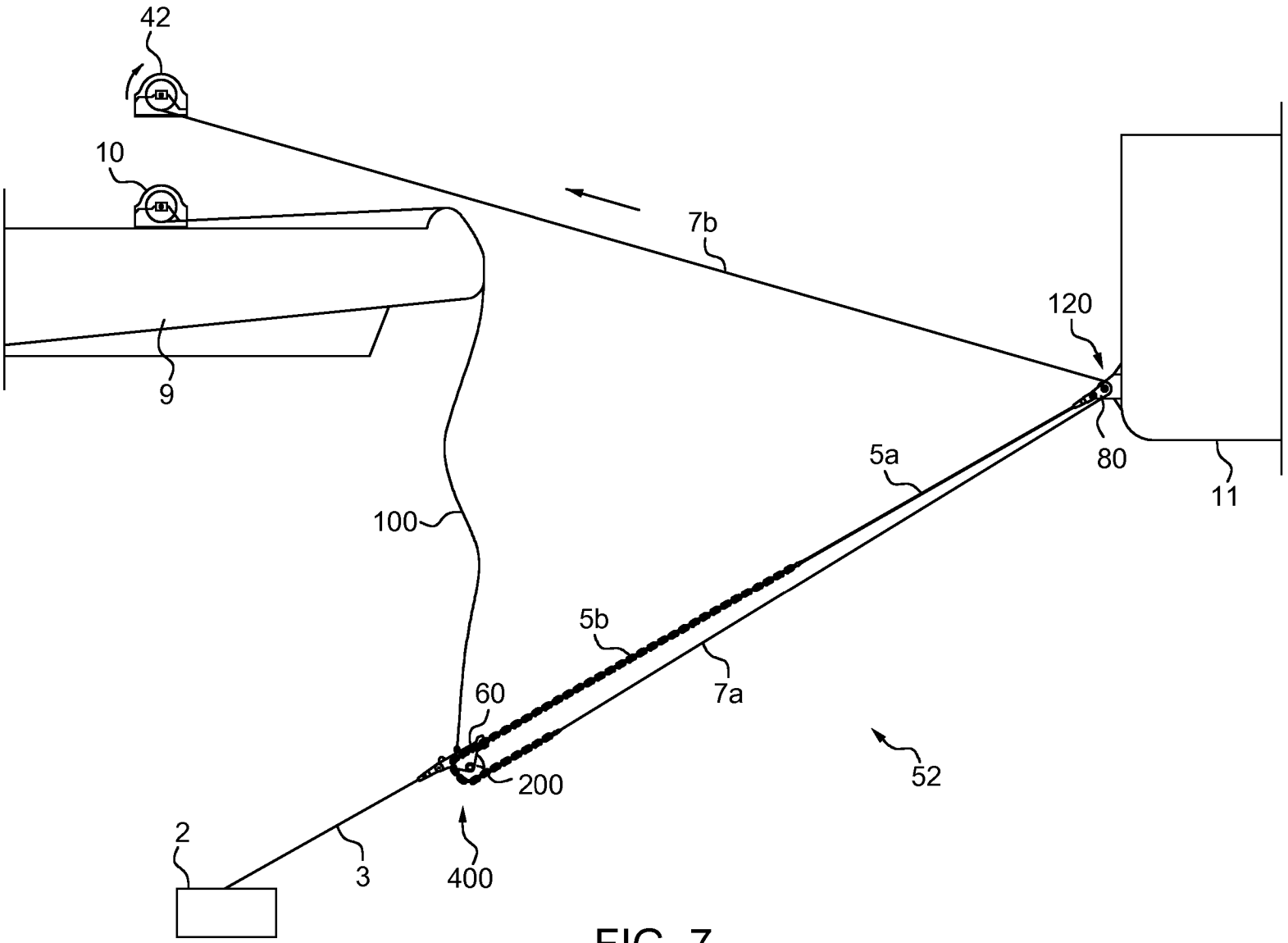
FIG. 7 shows the tensioning of the mooring line up to a pretension level with an arrangement according to a third embodiment of the invention.
Figure 8:
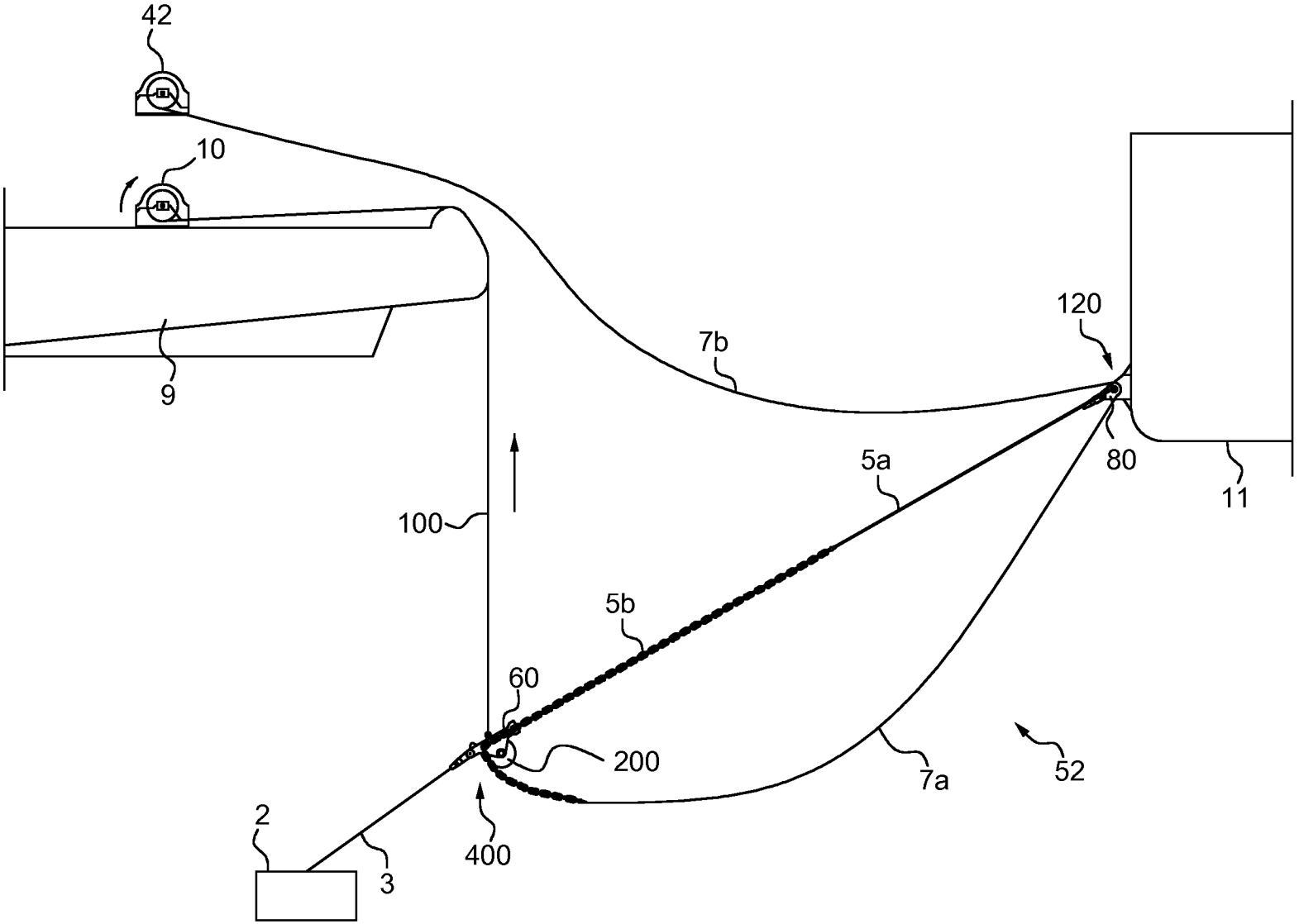
FIG. 8 shows the tensioning of the polyester line to remove creep in the line of the third embodiment of the invention as shown in FIG. 7.

FIGS. 7 and 8 discloses a third embodiment of the inline tensioner according to the invention. In this embodiment, the pretension can reach a pretension level of 2× bollard pull of the installation vessel 9 as will be further described below.

This means that the arrangement of the pretension arrangement 52 results in a tensioning force from the installation vessel 9 up to two times higher than the arrangement shown in FIG. 3-4.

FIG. 7 shows the arrangement for the pre-tensioning the mooring line 3, 5, 7 up to the pretension level.

In this embodiment the mooring line 3, 5, 7 have a different arrangement than in the previous embodiments.

The mooring rope 3 extending between the anchor 2 and a midwater coupling 400.

In the FIG. 7 there is shown a pedant wire 5*a* attached to the floating structure 11. The pedant wire 5*a* is attached to the floating structure through a fairlead arrangement 120 that is attached to the hull of the floating structure 11. The other end of the pendant wire 5*a* is attached to the mooring chain 5*b*. The mooring chain 5*b* extends through a midwater chain stopper 60 and around a chain pulley 200 arranged on a midwater coupling 400. The midwater coupling 400 is similar as the midwater coupling 4, 40 disclosed in the previous embodiments and is arranged in a distance from the offshore structure 11.

The mooring chain 5*b* is in the opposite end of the pedant wire 5*a* attached to an installation wire 7.

In another embodiment of the invention the mooring chain 5*b* could be attached to the hull of the floating structure 11, without any pedant wire 5*a*.

The installation wire 7 extends further around a fairlead chain wheel 80 arranged in the fairlead arrangement 120 and further towards the installation vessel 9.

The installation wire 7 is arranged in connection with the first winch 42 in the same way as in the other embodiments.

The installation wire 7 is divided in two flights: a first flight 7*a* extending from the mooring chain 5 towards the fairlead chain wheel 80. A second flight 7*b* extending from the fairlead chain wheel 80 towards the installation vessel 9.

The flights 7*a*, 7*b* constitute a continuous wire or line 7.

The first flight 7*a* of the installation wire 7 is substantially parallel to the mooring chain 5*b* and the pedant wire 5*a*.

The FIG. 8 shows the stretch removal arrangement with the second tensioning line 100 arranged between the midwater coupling 400 and the installation vessel 9. The second winch 10 is configured to pull in the second tensioning line 100 and thereby impose the latitudinal force on the part of the mooring line 3, 5 situated between the anchor 2 and the floating structure 11 as described in FIG. 3. This first winch 42 and the second winch 10 may also be the same if the installation wire is removed before re-tensioning with the tensioning line 100 as described above.

Figure 9:
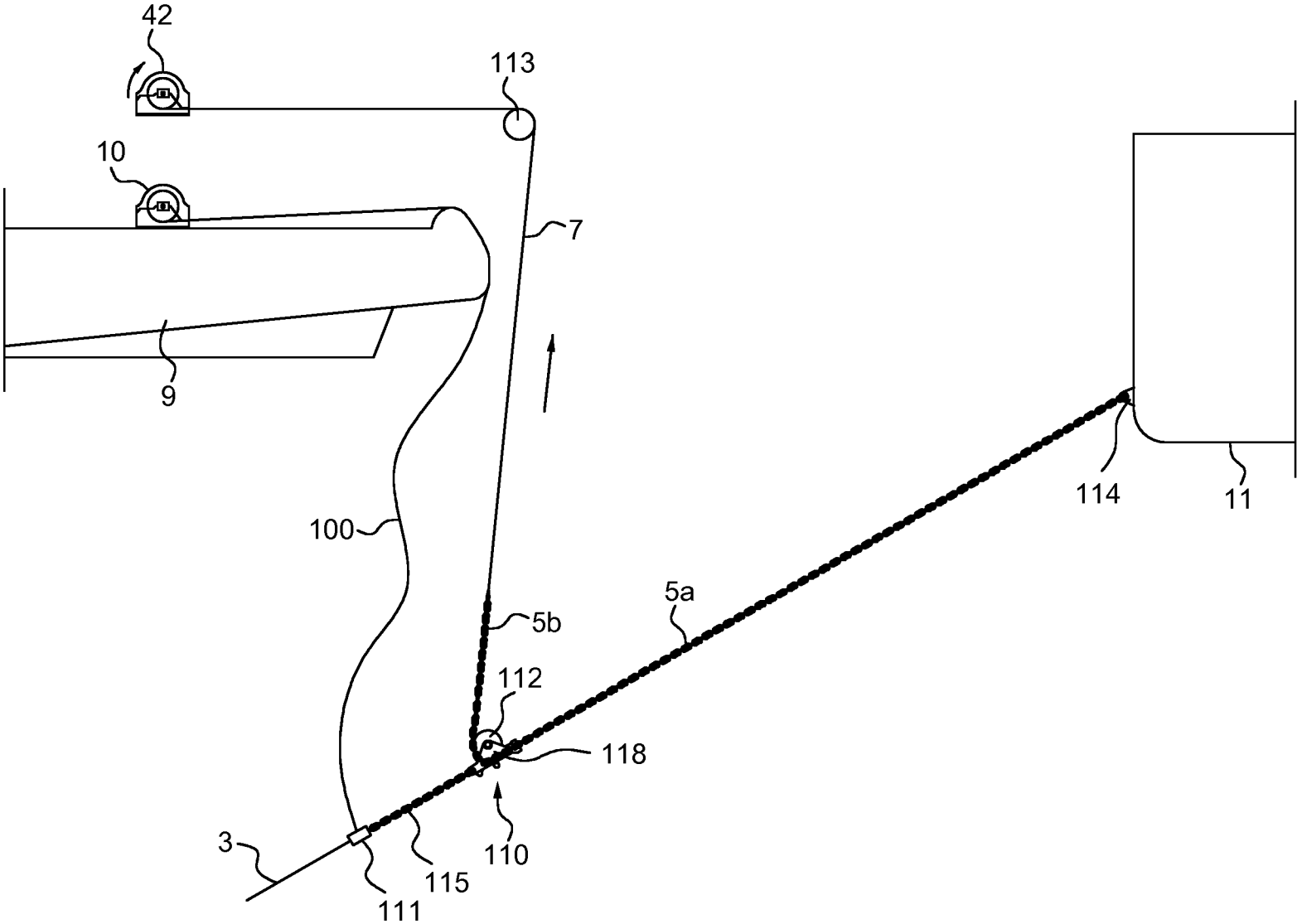
FIG. 9 shows tensioning of the mooring line up to a pretension level with an arrangement according to a fourth embodiment of the invention
Figure 10:
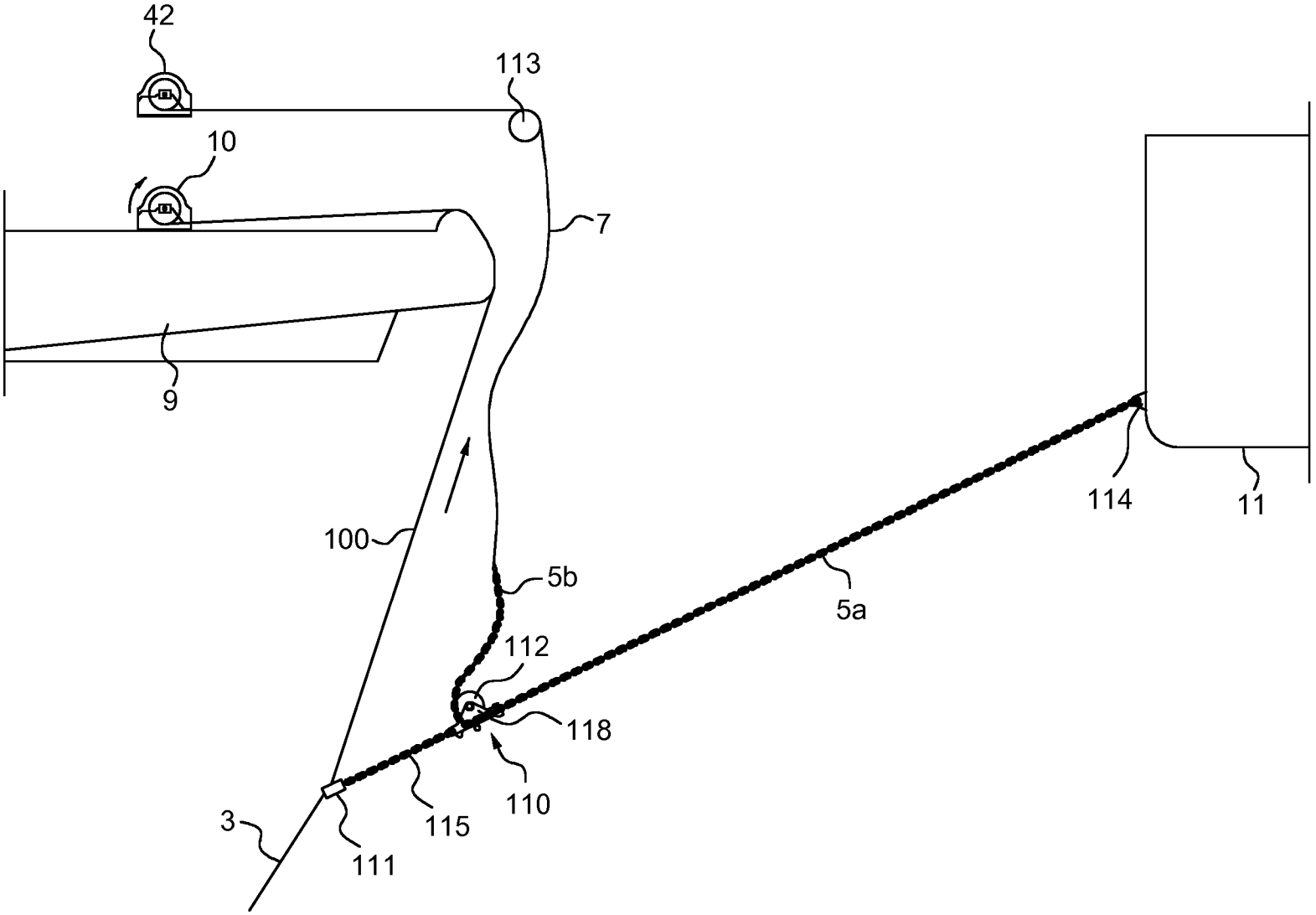
FIG. 10 shows the tensioning of the polyester line to remove creep in the line of the fourth embodiment of the invention as shown in FIG. 9.

FIGS. 9 and 10 shows a fourth embodiment of the inline tensioner according to the invention.

This embodiment is similar to the first embodiment disclosed in FIGS. 3 and 4 in that the mooring line is arranged so that a pretension can reach a pretension level of 1× bollard pull of an installation vessel 9.

The arrangement of the mooring chain 5, installation wire 7 and midwater coupling 111 are however different as will be described below.

FIG. 9 shows the arrangement for pre-tensioning the mooring line 3, 5, 7 according to the embodiment shown.

The mooring rope 3 is in this embodiment extending from the anchor 2 to a midwater coupling 111. There is arranged a chain link 115 between the midwater coupling 111 and the midwater tensioning pulley arrangement 110.

The midwater coupling 111 and midwater tensioning pulley device 110 are thus separate arrangement, unlike the embodiments disclosed in FIG. 5-6*a*, 7-8 where the midwater coupling and the midwater pulley are attached to each other in an integrated arrangement 40, 60.

The midwater tensioning pulley device 110 comprising a midwater pulley 112 and a chain stopper 118.

The mooring chain 5 is attached in one end to the offshore floating structure 11 and extending through the chain stopper 118 and around the midwater pulley 112. The mooring chain 5 is in the other end connected to an installation wire 7. The installation wire 7 is further extending around a second wire pulley 113 arranged at the installation vessel 9 and further towards the pulling unit or winch 42 arranged on the installation vessel 9.

The mooring chain 5 could be attached to the floating structure 11 for instance through a bracket 114 or similar ways.

FIG. 10 shows the stretch removal or re-tensioning arrangement and the process for removing the stretch in the polyester rope 3 according to the fourth embodiment of the invention.

The tensioner line 100 is attached in one end to the midwater coupling 111 and in the other end connected to a second pull in unit or winch 10. The tensioning line 100 is extending between the midwater coupling 111 and the installation vessel 9.

After the pre-tensioning of the mooring line by the first winch 42, the tensioner line 100 is being pulled in by the second winch 10. This results in that the line imposes a lateral force on the mooring line that is pre-tensioned between the anchor 2 and the offshore floating structure 11. This results as previously described that the stretch removal arrangement in this way can remove more stretch in the polyester rope with less forces acting than by imposing only tensioning forces to the mooring line.

In this embodiment the tensioning line 100 is not arranged perpendicular to the mooring line 3, 5, 7.

The installation vessel and the midwater coupling 4, 40, 400, 111 could be arranged so that the angle between the chain link 115 and the tensioner line 100 is less than 90°.

This provides that the tensioning forces acting in the mooring rope 3 between the anchor and the midwater coupling is higher than the tensioning forces in the mooring line part 5 acting between the midwater coupling and the floating structure 11. This is suitable when the mooring rope 3 have most of the polyester rope in the mooring line 3, 5, 7.

There could however be other configurations of the mooring line 3, 5, 7.

The different parts; mooring rope 3, mooring chain 5 and installation wire 7 may comprise segments of polyester ropes in addition to chain or wire parts.

Figure 11:
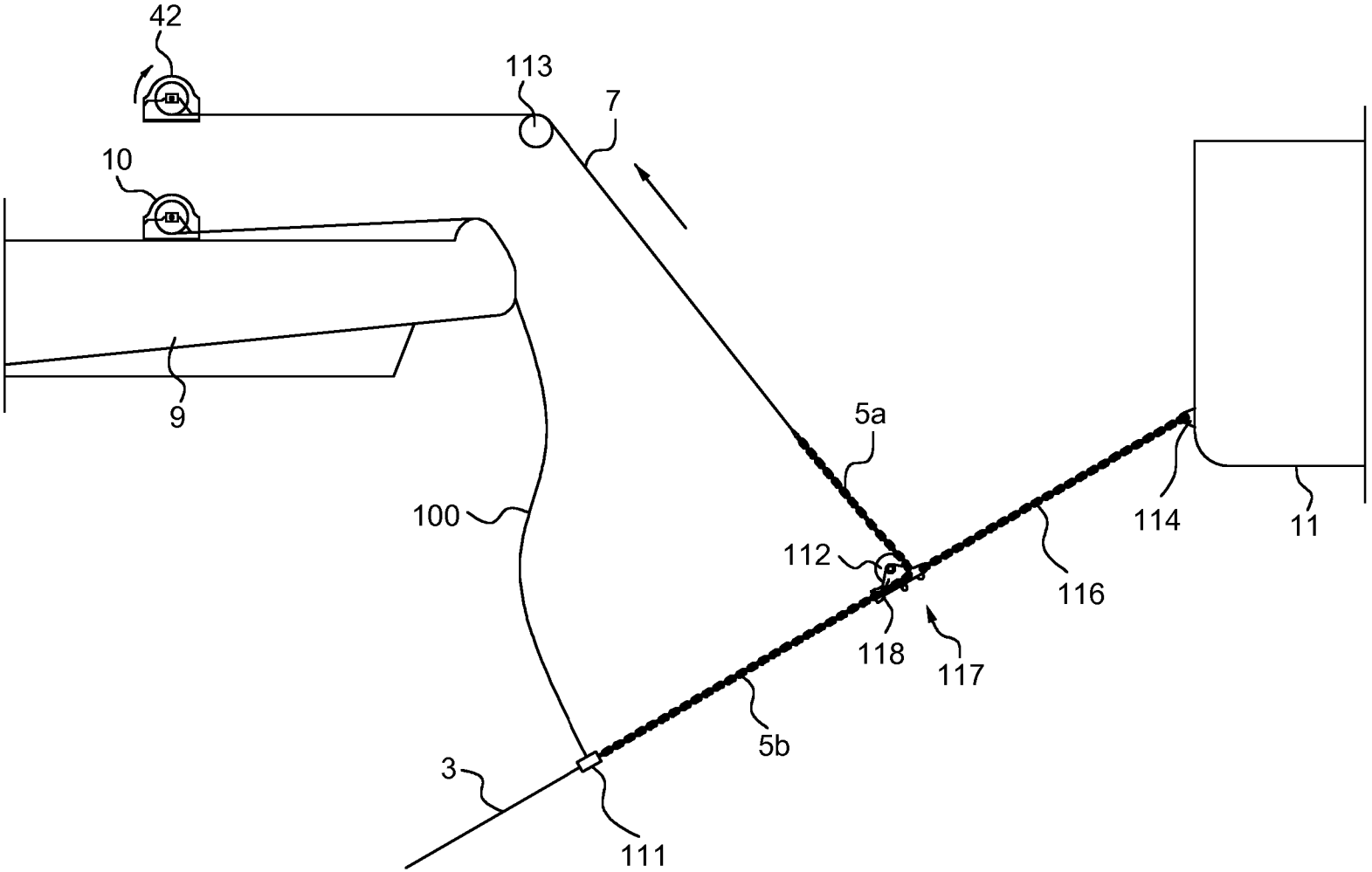
FIG. 11 shows tensioning of the mooring line up to a pretension level with an arrangement according to a fifth embodiment of the invention
Figure 12:
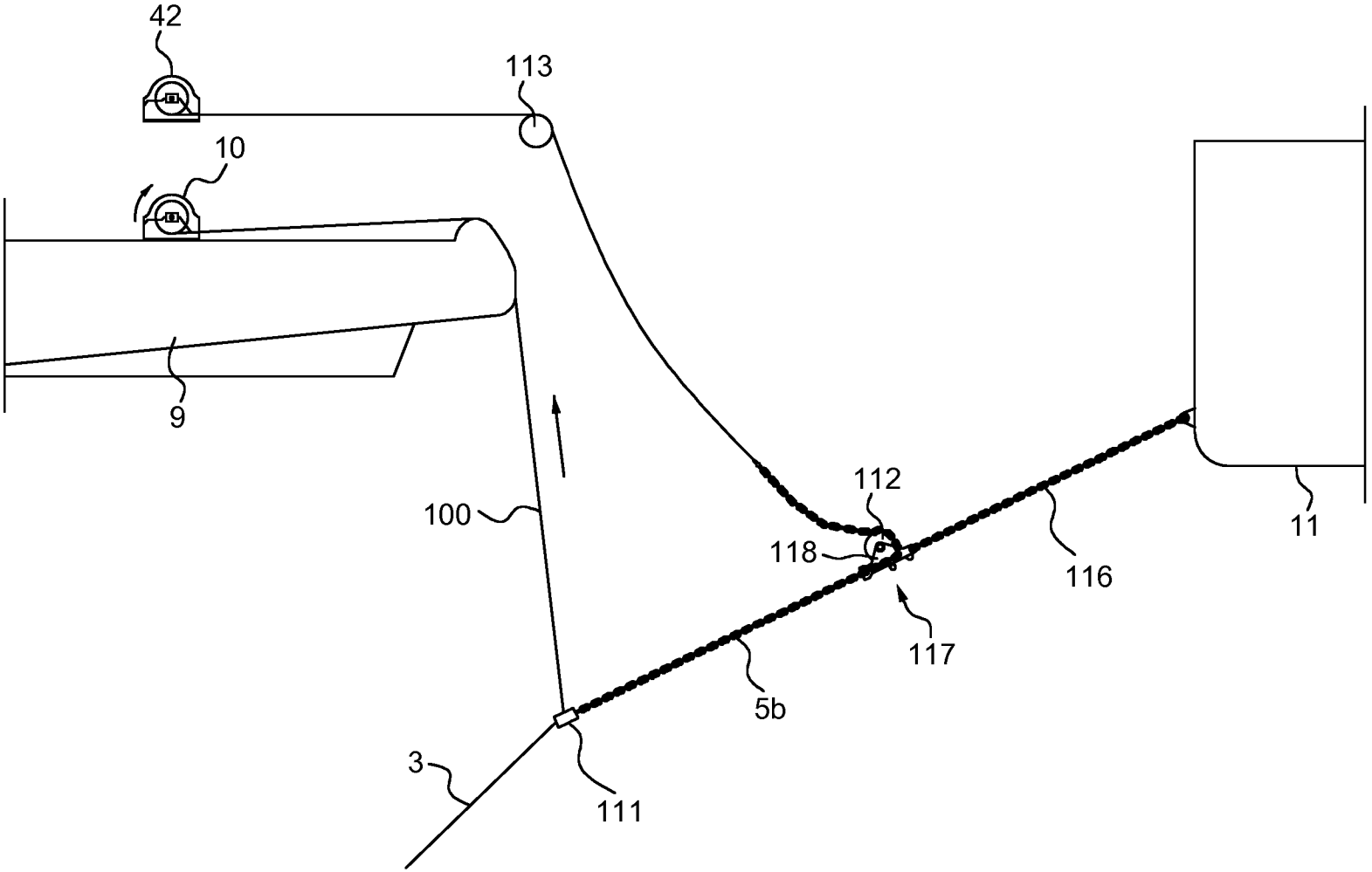
FIG. 12 shows the tensioning of the polyester line to remove creep in the line of the fifth embodiment of the invention as shown in FIG. 11.

FIGS. 11 and 12 shows a fourth embodiment of the inline tensioner according to the invention.

This embodiment is very similar to the fourth embodiment. The difference is the arranging of the mooring chain 5. The fifth embodiment comprises a midwater coupling 111 and a midwater tensioning arrangement 117 that are separate embodiments as in the embodiment disclosed in FIGS. 9 and 10.

The midwater tensioning arrangement 117 comprises a chain stopper 118 and a midwater pulley 112.

Instead of the chain link 115 between the midwater coupling 111 and the midwater tensioning arrangement 110, the mooring chain 5 is attached to the midwater coupling 111 in one end. The mooring chain 5 extends further through the chain stopper 118 and around the midwater pulley 112. The mooring chain 5 is in the other end connected to the installation wire 7 that further extends around the second wire pulley 113 to the pull in unit or winch 42.

A second chain link 116 is extending between the midwater tensioning arrangement 117 and the floating structure 11 and are attached in both ends to these respective parts.

FIG. 12 shows the same stretch removal arrangement and the process for removing the stretch in the polyester rope 3 as described in the other embodiments.

In a similar way as described in previous embodiments, the installation wire 7 may be both attached to the mooring chain 5*a*, 5*b* as shown in the figure of it may be detached from the mooring chain 5*a*, 5*b* in the re-tensioning process. This being embodiments of the invention.

It is to be understood that the present invention is not to be limited by the embodiments of the invention described herein. Indeed, those skilled in the art will readily understand that various modifications and embodiments of the invention may be made and practiced without departing from the scope of the invention.

The invention claimed is:

1. A method for tensioning a mooring arrangement for a floating structure or a vessel, the mooring tensioning arrangement comprising a mooring line having a first mooring part and a second mooring part, divided by a midwater coupling, at least a portion of the mooring line is made of synthetic material, the mooring line is extending between an anchor arranged on the seabed and a pulling unit arranged separate from or attached to the floating structure or vessel, the mooring line is extending at least via a fairlead pulley or chain wheel arranged on the floating structure between the anchor and the pulling unit wherein the method comprising the following steps:

a) imposing a pre-tensioning force on the mooring line by tightening the mooring line by the pulling unit, the force being directed towards the floating structure or vessel, until a pretension level in the mooring line is reached, b) maintaining the pretension level in the part of the mooring line extending between the anchor and the floating structure, c) arranging a second tensioning line between the midwater coupling and the pulling unit, d) imposing a substantially transverse force on the part of the mooring line extending between the anchor and the floating structure in order to remove stretch in the mooring line; and e) retightening of the mooring line.

2. The method for tensioning a mooring arrangement according to claim 1, wherein the tensioning arrangement further comprising a chain stopper configured to maintaining the pretension force imposed on the mooring line, wherein the tensioning line is extending substantially perpendicular from the mooring line.

3. The method for tensioning a mooring arrangement according to claim 1, wherein the tensioning in step d) is performed along the tensioning line, wherein the tensioning line is extending substantially perpendicular from the mooring line.

4. The method for tensioning a mooring arrangement according to claim 1, wherein the tensioning in step d) is performed along the tensioning line having an angle of less than 90° to the second mooring line part arranged between the midwater coupling and the floating vessel.

5. The method for tensioning a mooring arrangement according to claim 1, wherein the mooring line is from the fairlead pulley or chain wheel further extending back around a midwater pulley situated on the mooring line between the midwater coupling and the floating structure, the mooring line is further extending via a second pulley arranged on the offshore structure towards the pulling unit.

6. The method for tensioning a mooring arrangement according to claim 1, wherein the second part of the mooring line is arranged separate from the first part of the mooring line, the second part of the mooring line is fixedly attached to the offshore structure and is extending around a midwater pulley coupled to the midwater coupling, the second part of the mooring line is further extending via the fairlead pulley or chain wheel towards the pulling unit.

7. The method for tensioning a mooring arrangement according to claim 1, wherein the second part of the mooring line is arranged separate from the first part of the mooring line, the second part of the mooring line is fixedly attached to the offshore structure and is extending around a midwater pulley coupled to the midwater coupling the second part of the mooring line is further extending towards the pulling unit.

8. The method for tensioning the mooring arrangement according to claim 1, wherein steps a)-d) are repeated at least one time.

9. The method for tensioning the mooring arrangement according to claim 1, wherein the mooring line part extending between the floating structure and the pulling unit is disconnected from the mooring line part extending between the midwater coupling, and the floating structure is disconnected between the pre-tensioning step and the re-tensioning step.

10. A mooring tensioning arrangement for a floating structure or a vessel, comprising a mooring line having a first mooring part and a second mooring part, divided by a midwater coupling, at least a portion of the mooring line is made of synthetic material, the mooring line is extending between an anchor arranged on the seabed and a pulling unit arranged separate from the floating structure or vessel, the mooring line is extending at least via a fairlead pulley or a chain wheel arranged on the floating structure between the anchor and the pulling unit when the mooring line being pre-tensioned, a chain stopper being arranged in connection with the mooring line between the anchor and the floating vessel or structure for tensioning the part of the mooring line situated between the floating structure and the anchor at a pretension level, wherein the mooring tensioning arrangement further comprising a second tensioning line configured to be attached in one end to the midwater coupling and in the other end coupled to the pulling unit when the mooring line being re-tensioned, the midwater coupling and the pulling unit being arranged relative to each other such that the tensioning line is configured to impose a lateral force on the part of the mooring line arranged between the anchor and the floating structure for removing stretch in the mooring line.

11. The mooring tensioning arrangement according to claim 10, wherein the second tensioning line is extending substantially perpendicular from the part of the mooring line situated between the anchor and the floating structure or vessel.

12. The mooring tensioning arrangement according to claim 10, wherein the angle between the tensioning line and the second mooring line part arranged between the midwater coupling and the floating structure is less than 90° .

13. The mooring tensioning arrangement according to claim 10, wherein the chain stopper is attached to the fairlead pulley or chain wheel on the offshore structure or the vessel.

14. The mooring tensioning arrangement according to claim 10, wherein the chain stopper (not shown) being attached to the anchor at the seabed.

15. The mooring tensioning arrangement according to claim 10, wherein the mooring line is extending further from the fairlead chain wheel arranged on the offshore structure back towards a midwater pulley arranged in connection with the part of the mooring line situated between the mooring midwater coupling and the floating structure, the mooring line is further extending from the midwater pulley to a wire pulley arranged on the offshore structure and further towards the pulling unit.

16. The mooring tensioning arrangement according to claim 10, wherein the chain stopper is coupled to the midwater coupling.

17. The mooring tensioning arrangement according to claim 16, wherein the second part of the mooring line is arranged separate from the first part of the mooring line, the second part of the mooring line is fixedly attached in one end attached to the offshore structure and is extending around a midwater pulley coupled to the midwater coupling the second part of the mooring line is further extending via the fairlead pulley or chain wheel towards the pulling unit.

18. The mooring tensioning arrangement according to claim 16, wherein the second part of the mooring line is arranged separate from the first part of the mooring line, the second part of the mooring line is fixedly attached to the offshore structure and is extending around a midwater pulley coupled to the midwater coupling the second part of the mooring line is further extending towards the pulling unit.

19. The mooring tensioning arrangement according to claim 15, wherein the midwater coupling and the midwater pulley being attached to each other in one integrated device.

20. The mooring tensioning arrangement according to claim 10, wherein the midwater pulley is coupled to the floating structure.

* * * * *